US008773256B2

(12) United States Patent
Ten Kate et al.

(10) Patent No.: US 8,773,256 B2
(45) Date of Patent: Jul. 8, 2014

(54) FALL PREVENTION SYSTEM HAVING A SENSOR FOR DETERMINING AN INDICATION OF THE RISK OF A FALL

(75) Inventors: Warner Rudolph Theophile Ten Kate, Eindhoven (NL); Floris Maria Hermansz Crompvoets, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 322 days.

(21) Appl. No.: 13/264,542

(22) PCT Filed: May 3, 2010

(86) PCT No.: PCT/IB2010/051923

§ 371 (c)(1), (2), (4) Date: Oct. 14, 2011

(87) PCT Pub. No.: WO2010/128444

PCT Pub. Date: Nov. 11, 2010

(65) Prior Publication Data

US 2012/0050031 A1 Mar. 1, 2012

(30) Foreign Application Priority Data

May 4, 2009 (EP) ..... 09159314

(51) Int. Cl.
*G08B 21/00* (2006.01)
*G08B 21/04* (2006.01)

(52) U.S. Cl.
CPC ..... *G08B 21/04* (2013.01)
USPC ..... 340/539.11; 340/573.1; 600/595

(58) Field of Classification Search
USPC ..... 340/573.1, 573.7, 539.11, 539.12; 600/587, 592, 595
See application file for complete search history.

(56) References Cited

U.S. PATENT DOCUMENTS

2004/0015103 A1 1/2004 Aminian et al.
2008/0108913 A1 5/2008 Lengsfeld et al.

FOREIGN PATENT DOCUMENTS

JP 2003216743 A 7/2003
WO 2006038712 A1 4/2006
WO 2007141461 A1 12/2007
WO 2008005867 A2 1/2008

OTHER PUBLICATIONS

Sherrick, C.E. et al, "Cutaneous Sensitivity in Handbook of Perception and Human Performance,", vol. 1: Sensory and Perception, pp. 12-1 12-58, 1986.

*Primary Examiner* — Jeffery Hofsass

(57) ABSTRACT

There is provided a fall prevention system that is suitable for being worn by a user, comprising a sensor for determining an indication of the risk of the user falling; two or more feedback devices for attachment to respective parts of the user's body, each feedback device being controllable to apply feedback to said respective part; and a controller configured to control the two or more feedback devices such that feedback is applied to a particular part of the user's body in response to the determined indication.

19 Claims, 2 Drawing Sheets

FALL PREVENTION SYSTEM HAVING A SENSOR FOR DETERMINING AN INDICATION OF THE RISK OF A FALL

TECHNICAL FIELD OF THE INVENTION

The invention relates to a fall prevention system method, and in particular to a fall prevention system and method in which a user is warned that they are at risk of falling by tactile feedback applied to their body.

BACKGROUND TO THE INVENTION

People with an unstable gait are at risk of falling. Unstable gait occurs among many groups of people, for example, the elderly, people with cerebral palsy, bilateral vestibular loss (BVL), dementia or Parkinson's disease, people who have suffered a stroke, an amputation, a bone fracture or a hip replacement, in particular during the period of rehabilitation after the stroke or hip replacement or women who are pregnant.

There are a number of devices available for people to wear that can alert the user that they may be at a temporarily increased risk of falling, for example if they are unbalanced. Particular devices provide a belt that is worn around the user's waist and that vibrates in response to a measurement of the inclination of the user's posture that indicates that the user is unbalanced or at an increased risk of falling. On sensing the vibration, the user is made aware that they are at an increased risk of falling. The type of tactile feedback used in these devices is sometimes referred to as "vibrotactile".

In fall prevention, it is less of a concern to control balance, but rather to warn the user when their balance is temporarily reduced, for example because the person is paying attention to something in addition to walking, or the environmental conditions are suboptimal (for example there is dimmed lighting, an irregular ground surface, an overload of the auditory and visual systems due to too many stimuli, such as conversations, etc.).

In these cases, as the user is distracted, providing continuous feedback to the user on their posture is less effective at preventing falls.

There is therefore a need for an improved fall prevention system and method that overcomes the disadvantages with the known devices.

SUMMARY OF THE INVENTION

According to a first aspect of the invention, there is provided a fall prevention system comprising fall prevention system that is suitable for being worn by a user, comprising a sensor for determining an indication of the risk of the user falling; two or more feedback devices for attachment to respective parts of the user's body, each feedback device being controllable to apply feedback to said respective part; and a controller configured to control the two or more feedback devices such that feedback is applied to a particular part of the user's body in response to the determined indication.

According to a second aspect of the invention, there is provided a method of operating a fall prevention system that is being worn by a user, the method comprising attaching two or more feedback devices to respective parts of the user's body, each feedback device being controllable to apply feedback to said respective part; determining an indication of the risk of the user falling; and controlling said feedback devices to apply feedback to one of said respective parts of the user's body in response to the determined indication.

BRIEF DESCRIPTION OF THE DRAWINGS

The invention will now be described, by way of example only, with reference to the following drawings, in which.

DETAILED DESCRIPTION OF THE PREFERRED EMBODIMENTS

Figure 1:
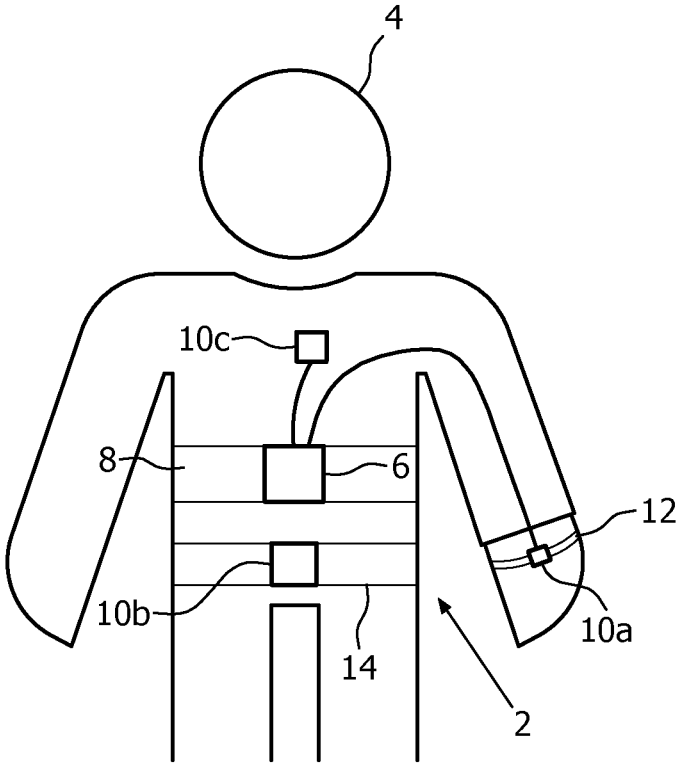
FIG. 1 is an illustration of a user wearing an exemplary fall prevention system according to the invention.

FIG. 1 shows an exemplary fall prevention system 2 according to the invention.

The fall prevention system 2 is worn by a user 4 and comprises a central unit 6 that is attached around the user's torso by a strap 8 and a number of feedback devices 10*a*, 10*b* and 10*c* that are attached to respective parts of the body of the user 4.

For example, feedback device 10*a* is attached to the user's left wrist by a strap 12, feedback device 10*b* is attached at the user's waist by a belt 14 and feedback device 10*c* is attached to the user's left shoulder.

In this illustrated embodiment, the feedback devices 10 are vibrotactile feedback devices that generate vibration that can be felt by the user 4 at the part of the body to which the feedback device 10 is attached.

Figure 2:
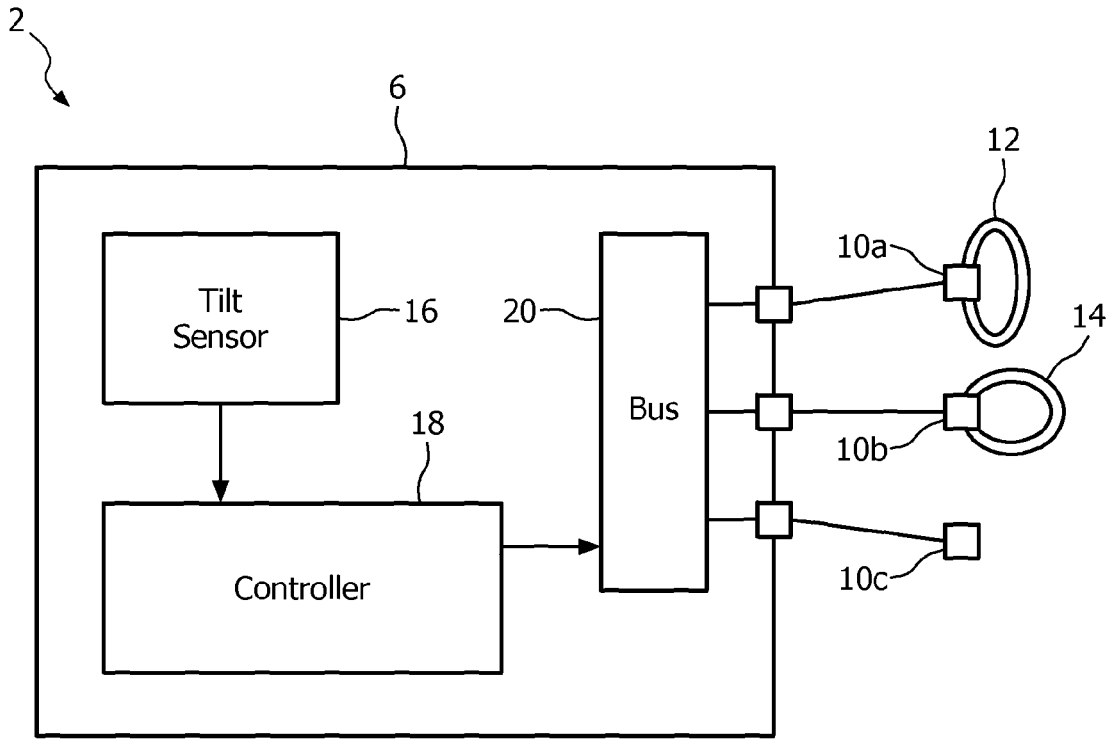
FIG. 2 is a block diagram of the exemplary fall prevention system in FIG. 1.

FIG. 2 shows the fall prevention system 2 in more detail. In particular, the central unit 6 of the fall prevention system 2 comprises a sensor 16, such as a tilt sensor, for measuring the tilt or inclination of the posture of the user 4 relative to the vertical, a controller 18 that receives the measurements from the sensor 16 and a bus 20 that is connected to the controller 18 and that provides an interface between the controller 18 and feedback devices 10*a*, 10*b* and 10*c*.

The sensor 16 can comprise a transducer that provides a signal corresponding to the tilt or inclination of the posture of the user 4 relative to the vertical to the controller 18 for further processing (for example to determine an indication of the risk of the user 4 falling). Alternatively, the sensor 16 can include some processing means that executes an algorithm to determine the indication of the risk of the user 4 falling from the signal from the transducer, and can provide this indication to the controller 18.

It has been found that the sensitivity or effectiveness of vibrotactile feedback depends on the part of the body to which the feedback is applied. In particular, the human somatosensory system is very sensitive to vibrations—it can detect vibrations with amplitudes smaller than 1 micrometer at around 250 Hz (Sherrick, C. E., and R. W. Cholewiak. 1986. Cutaneous sensitivity In Handbook of Perception and Human Performance, Vol. 1: Sensory Processes and Perception, pp. 12-1 12-58).

Therefore, fall prevention can be improved by applying tactile feedback to different body parts depending on the instantaneous fall risk to the user 4. In particular, the controller 18 can be configured to control the feedback devices 10 such that feedback is applied to more sensitive parts of the user's body as the indication of the risk of the user 4 falling increases. Thus, the controller 18 can be configured to control the feedback devices 10 such that feedback is applied to a more sensitive part of the user's body when the indication of the risk of the user falling is relatively high, and such that feedback is applied to a less sensitive part of the user's body when the indication of the risk of the user falling is relatively low. In the following, "more sensitive" and "less sensitive" should be understood as meaning that they invoke a more/less alerting response in the user 4 when feedback is applied to the particular body parts.

In particular, it has been found that the sensation of vibrotactile feedback is perceived as mild when applied to the waist, moderate when applied to the wrist, and as an acute warning when applied to the shoulders. Thus, a fall prevention system 2 according to the invention places feedback devices 10 at locations of the body with differing sensitivity to vibrotactile feedback, and applies vibrotactile feedback to a part of the body in accordance with the determined severity of the situation (i.e. how high the risk is that the user 4 will fall).

Therefore, in accordance with the invention, the fall prevention system 2 provides a warning to the user 4 that they are at an increased risk of falling by applying vibrotactile feedback to a part of the user's body that is determined in accordance with the instantaneous risk of falling.

For example, in the illustrated embodiment, when the user 4 is balanced (or slightly unbalanced, but within acceptable limits) no vibrotactile feedback will be applied to the user 4. However, if the user's risk of falling is "slight" (as determined from the measurements from the tilt sensor 16), the controller 18 can activate the feedback device 10 located at the user's waist (feedback device 10*b*). Thus, when the user's gait is normal, no feedback is applied or the feedback device 10*b* at the waist is activated, which is comparable to the known systems that aim to help control balance.

If the user's risk of falling is determined to be "moderate" (again as determined from the measurements from the tilt sensor 16), the controller 18 can activate feedback device 10*a* located at the user's left wrist (and deactivate the other feedback device or devices 10 if they are active). However, if the user's risk of falling is determined to be "severe", the controller 18 can activate feedback device 10*c* located on the user's shoulder, as this is perceived by the user 4 to be the most alarming sensation.

It will be appreciated in the above discussion that the "slight" risk of falling is a relatively low risk when compared to a "moderate" or "severe" risk; the "moderate" risk is a relatively high risk when compared to the "slight" risk and a relatively low risk when compared to the "severe" risk; and the "severe" risk of falling is a relatively high risk of falling when compared to the "slight" or "moderate" risks.

In this way, the fall prevention system 2 will alert the user 4 that they should take care, for example by paying more attention to their walking or by taking a rest, and thus the risk of falling should decrease. If the balance of the user 4 (as indicated by the measurements from the sensor 16) doesn't improve or gets worse, the controller 18 can activate the feedback device located at the user's shoulder, indicating to the user that they really should take some action to improve their balance. If the balance of the user 4 still does not improve, the system 2 can alert a care provider, perhaps using a wireless connection to a care provider's computer.

Figure 3:
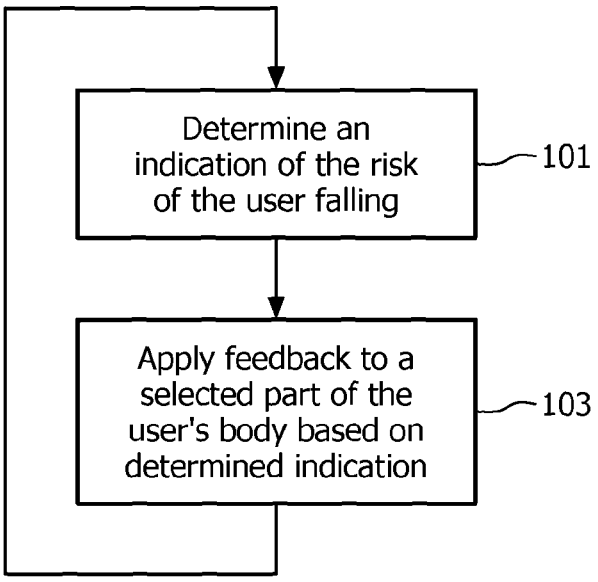
FIG. 3 is a flow chart illustrating the steps in accordance with the invention.

The procedure executed by the fall prevention system 2 in accordance with the invention is illustrated in FIG. 3. In step 101, an indication of the risk of the user 4 falling is determined from measurements from the sensor 16. In step 103, the controller 18 applies vibrotactile feedback to a selected part of the user's body in accordance with the indication of the balance of the user 4.

In the illustrated embodiment, the indication of the risk of the user 4 falling is determined in terms of their balance using inertial sensors, such as a tilt sensor. Based on the measured direction of gravity, the inclination (amount of tilt) and the azimuth (direction of tilt) can be estimated. In addition, the stability of the gait pattern of the user 4 can be estimated and used as a measure by the controller 18 to decide which feedback devices 10 to activate.

The particular thresholds applied to the measure of the balance of the user 4 can be set depending on the particular user 4. For example, as gait varies between individuals, an inclination or gait measurement for one user 4 that is "normal" (and balanced) could actually be abnormal (i.e. potentially unbalanced) for another user 4.

In alternative embodiments of the invention, the fall prevention system 2 can comprise feedback devices 10 at just two different parts of the user's body, rather than three. In these embodiments, it is still possible to apply feedback to different parts of the body of the user in order to convey different levels of alarm responsive to the current balance of the user 4.

In further embodiments, feedback devices 10 can be located on more than three parts of the user's body. In these embodiments (and also the embodiments described above), the feedback devices 10 and, optionally, the central unit 6, can be integrated into an item of clothing that can be worn by the user 4. The feedback devices 10 can be distributed over the torso of the user 4.

It will be appreciated that, in alternative embodiments, it is possible to provide feedback devices 10 on both sides (i.e. left and right) of the user's body. In yet further embodiments, feedback devices 10 can be provided on the front and back of the user's body. In any of these embodiments, the controller 18 can control the application of feedback to the user 4 based on the direction in which the user 4 is unbalanced. For example, if the user 4 is unbalanced to the left (i.e. they are at risk of falling to their left), the controller 18 can apply feedback to a particular part of the user 4 using a feedback device 10 attached on the left side of the user's body so that the user 4 is aware of which way they are likely to fall. Of course, it will be appreciated that in this embodiment, the controller could alternatively apply the feedback to the opposite side of the user's body to that in which they are likely to fall (i.e. the feedback could be applied to the right side if the user 4 is likely to fall to the left).

The fall prevention system 2 may be provided with further functionality normally associated with fall prevention or detection devices, such as an alarm that triggers in the event that a fall is detected, and/or a button that the user 4 can use to summon assistance.

While the invention has been illustrated and described in detail in the drawings and foregoing description, such illustration and description are to be considered illustrative or exemplary and not restrictive; the invention is not limited to the disclosed embodiments.

Variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A fall prevention system that is suitable for being worn by a user, comprising:

a sensor configured to determine an indication of the risk of the user falling;

two or more feedback devices configured for attachment to different parts of the user's body having different levels of sensitivity to feedback, each feedback device being controllable to apply the feedback to said respective part; and a controller configured to in response to the determined indication, control the feedback devices such that the feedback is applied to a more sensitive part of the user's body when the indication of the risk of the user falling is relatively high, and such that feedback is applied to a less sensitive part of the user's body when the indication of the risk of the user falling is relatively low.

2. A fall prevention system that is suitable for being comprising:

a sensor configured to determine an indication of a risk of the user falling;

two or more tactile feedback devices configured for attachment to different parts of a body of the user, the user's body including a higher part and a lower part, each of the feedback devices being controllable to apply the tactile feedback to one of the upper and lower parts of the user's body; and a controller configured to control the two or more feedback devices such that the tactile feedback is applied to the lower part of the user's body in the event that the indication indicates a relatively low risk of falling, and the upper part of the user's body in the event that the indication indicates a relatively high risk of falling.

3. The fall prevention system as claimed in claim 2, wherein the two or more feedback devices are configured for attachment to respective parts of the user's body having different levels of sensitivity to said feedback.

4. The fall prevention system as claimed in claim 1, wherein the controller is configured to control the feedback devices such that feedback is applied to more sensitive parts of the user's body as the indication of the risk of the user falling increases.

5. The fall prevention system as claimed in claim 3, wherein each of the two or more feedback devices is configured for attachment to a one of a waist of the user, a wrist of the user, and a shoulder of the user.

6. The fall prevention system as claimed in claim 3, wherein the controller is configured to control the feedback devices such that the feedback is applied to a more sensitive part of the user's body when the indication of the risk of the user falling is relatively high, and such that feedback is applied to a less sensitive part of the user's body when the indication of the risk of the user falling is relatively low.

7. The fall prevention system as claimed in claim 1, comprising three or more feedback devices, wherein at least two of the feedback devices are for attachment to respective sides of a part of the user's body; the indication further indicates a direction in which the user is at risk of falling, and the controller is configured to control the three or more feedback devices such that feedback is applied to a particular side of the part of the user's body in response to the determined indication.

8. The fall prevention system as claimed in claim 1, wherein each of the feedback devices comprises a vibrotactile feedback device.

9. A method of operating a fall prevention system that is being worn by a user, the method comprising:

attaching two or more tactile feedback devices to respective different parts of the user's body, each feedback device being controllable to apply feedback to said respective part wherein the two or more feedback device are attached to respective parts of the user's body having different levels of sensitivity to said feedback;

determining an indication of the risk of the user falling; and controlling said feedback devices to apply feedback to one of said respective parts of the user's body in response to the determined indication.

10. The method as claimed in claim 9, wherein the step of controlling comprises controlling the feedback devices to apply feedback to a more sensitive part of the user's body when the indication of the risk of the user falling is relatively high, and to apply feedback to a less sensitive part of the user's body when the indication of the risk of the user falling is relatively low.

11. The method as claimed in claim 9, wherein the step of controlling comprises controlling the feedback devices such that feedback is applied to more sensitive parts of the user's body as the determined indication of the risk of the user falling increases.

12. The method as claimed in claim 9, wherein the step of attaching comprises attaching the two or more feedback devices to a respective one of the waist of the user, a wrist of the user, and a shoulder of the user.

13. The method as claimed in claim 12, wherein the step of controlling comprises controlling the two or more feedback devices such that feedback is applied to a lower one of the parts of the user's body in the event that the indication indicates a relatively low risk of falling, and an upper one of the parts of the user's body in the event that the indication indicates a relatively high risk of falling.

14. The method as claimed in claim 9, wherein each feedback device is controllable to apply vibrotactile feedback to said respective part.

15. The fall prevention system as claimed in claim 1, wherein each of the two or more feedback devices is configured for attachment to a respective one of a waist of the user, a wrist of the user, and a shoulder of the user.

16. The fall prevention system as claimed in claim 1, wherein the controller is configured to control the two or more feedback devices such that feedback is applied to a lower one of the parts of the user's body in the event that the indication indicates a relatively low risk of falling, and an upper one of the parts of the user's body in the event that the indication indicates a relatively high risk of falling.

17. The fall prevention system as claimed in claim 2, wherein the controller is configured to control the feedback devices such that the tactile feedback is applied to more sensitive parts of the user's body as the indication of the risk of the user falling increases.

18. The fall prevention system as claimed in claim 2, comprising three or more feedback devices, wherein at least two of the feedback devices are for attachment to respective sides of a part of the user's body, the indication further indicates a direction in which the user is at risk of falling, and the controller is configured to control the three or more feedback devices such that feedback is applied to a particular side of the part of the user's body in response to the determined indication.

19. A fall prevention system as claimed in claim 2, wherein each of the feedback devices comprises a vibrotactile feedback device.

* * * * *